US010208571B2

(12) United States Patent
Yin et al.

(10) Patent No.: US 10,208,571 B2
(45) Date of Patent: Feb. 19, 2019

(54) FLOW CONDITIONING FLOW CONTROL DEVICE

(71) Applicant: Halliburton Energy Services, Inc., Houston, TX (US)

(72) Inventors: Weiqi Yin, Plano, TX (US); Frederic Nicolas Felten, Corinth, TX (US); Stephen Michael Greci, Little Elm, TX (US); Brandon Thomas Least, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/114,727

(22) PCT Filed: Apr. 13, 2015

(86) PCT No.: PCT/US2015/025550

§ 371 (c)(1),
(2) Date: Jul. 27, 2016

(87) PCT Pub. No.: WO2015/160695

PCT Pub. Date: Oct. 22, 2015

(65) Prior Publication Data

US 2016/0341016 A1 Nov. 24, 2016

Related U.S. Application Data

(60) Provisional application No. 61/979,909, filed on Apr. 15, 2014.

(51) Int. Cl.

| | |
|---|---|
| ***E21B 43/08*** | (2006.01) |
| *E21B 34/10* | (2006.01) |
| *E21B 43/04* | (2006.01) |

(52) U.S. Cl.
CPC ..... *E21B 43/086* (2013.01); *E21B 43/08* (2013.01); *E21B 43/084* (2013.01); (Continued)

(58) Field of Classification Search
CPC ..... E21B 43/08; E21B 43/084; E21B 43/086; E21B 43/088; E21B 43/10
See application file for complete search history.

(56) References Cited

U.S. PATENT DOCUMENTS

| | | | |
|---|---|---|---|
| 5,906,238 | A | 5/1999 | Carmody et al. |
| 8,628,293 | B2 | 1/2014 | Ramachandran et al. |

(Continued)

OTHER PUBLICATIONS

PCT International Search Report and Written Opinion of the International Searching Authority, PCT/US2015/025550, dated Jul. 13, 2015, 14 pages.

*Primary Examiner* — D. Andrews
*Assistant Examiner* — Kristyn A Hall
(74) *Attorney, Agent, or Firm* — Scott Richardson; Parker Justiss, P.C.

(57) ABSTRACT

A well screen assembly includes a tubing including a center bore and at least one aperture through the tubing between an outer radial surface of the tubing and an inner radial surface of the tubing; a filtration screen positioned around the tubing; a housing positioned around the tubing and including a fluid chamber in fluid communication with an outlet of the filtration screen; and a flow control device positioned in fluid communication with the outlet of the filtration screen and the at least one aperture to reduce a wall shear stress on at least one of the tubing or the at least one aperture.

17 Claims, 7 Drawing Sheets

(52) U.S. Cl.
CPC ..... *E21B 43/088* (2013.01); *E21B 34/106* (2013.01); *E21B 43/04* (2013.01)

(56) References Cited

U.S. PATENT DOCUMENTS

| | | | | |
|---|---|---|---|---|
| 2004/0112608 | A1 | 6/2004 | Jackson | |
| 2005/0155769 | A1* | 7/2005 | Sherwood | E21B 43/124 166/372 |
| 2005/0189106 | A1 | 9/2005 | Bode et al. | |
| 2006/0131033 | A1 | 6/2006 | Bode et al. | |
| 2009/0000787 | A1 | 1/2009 | Hill et al. | |
| 2013/0319664 | A1 | 12/2013 | McNamee et al. | |
| 2014/0000894 | A1 | 1/2014 | Coffey et al. | |
| 2014/0014358 | A1* | 1/2014 | Leitch | E21B 27/005 166/369 |
| 2014/0246206 | A1 | 9/2014 | Least et al. | |
| 2015/0013980 | A1 | 1/2015 | Duphorne et al. | |
| 2015/0027715 | A1 | 1/2015 | Tinnen et al. | |
| 2015/0261224 | A1 | 9/2015 | Lopez et al. | |
| 2015/0376983 | A1 | 12/2015 | Greci | |
| 2016/0153263 | A1* | 6/2016 | Jannise | E21B 43/02 166/373 |
| 2017/0254195 | A1* | 9/2017 | Knight | E21B 47/122 |

* cited by examiner

FLOW CONDITIONING FLOW CONTROL DEVICE

CROSS-REFERENCE TO RELATED APPLICATIONS

This application is a U.S. National Phase Application under 35 U.S.C. § 371 and claims the benefit of priority to International Application Serial No. PCT/US2015/025550, filed on Apr. 13, 2015, which claims the benefit of priority to U.S. Provisional Application Ser. No. 61/979,909, filed on Apr. 15, 2014, the contents of which are hereby incorporated by reference.

BACKGROUND

Inflow control devices (ICDs) can be used in a downhole tool to receive and filter a flow of wellbore fluid and for overall flux balance. The wellbore fluid can flow into the production pipe through perforation holes in the production pipe. In some instances, high wall shear stress may occur around one or more of the perforation holes on the production pipe. This wall shear stress, in some cases, may cause corrosion of the production pipe.

DETAILED DESCRIPTION

The present disclosure describes implementations of a well screen assembly (e.g., an inflow control device (ICD) or other downhole filtration tool). The well screen assembly may reduce, alter, or modify wall shear stress on a tubular member. In some implementations, the well screen assembly includes a center bore and an aperture through the tubing between an outer surface of the tubing and an inner surface of the tubing. The well screen further comprises a filtration screen positioned around the tubing, a housing positioned around the tubing and comprising a fluid chamber in fluid communication with an outlet of the filtration screen. The well screen assembly also has a flow control device positioned in fluid communication with the outlet of the filtration screen and the aperture to reduce a wall shear stress on the tubing or the aperture.

Various implementations of a well screen assembly according to the present disclosure include one, some, or all of the following features. The well screen may have a flow control device that includes a tubular sleeve positioned around the tubing adjacent to one aperture. The tubular sleeve may include a perforation to allow fluid to flow from the outlet of the filtration screen, through the tubular sleeve, and to the aperture. In some implementations, the perforation may be radially offset from the aperture. In some implementations, the tubular sleeve may have a plurality of perforations. Each of these features is intended to reduce, alter, or minimize shear stress on a tubular member. Reduced shear stress on a tubing or aperture can help prevent corrosion of the well screen components and therefore improve the durability of the well screen assembly.

Figure 1:
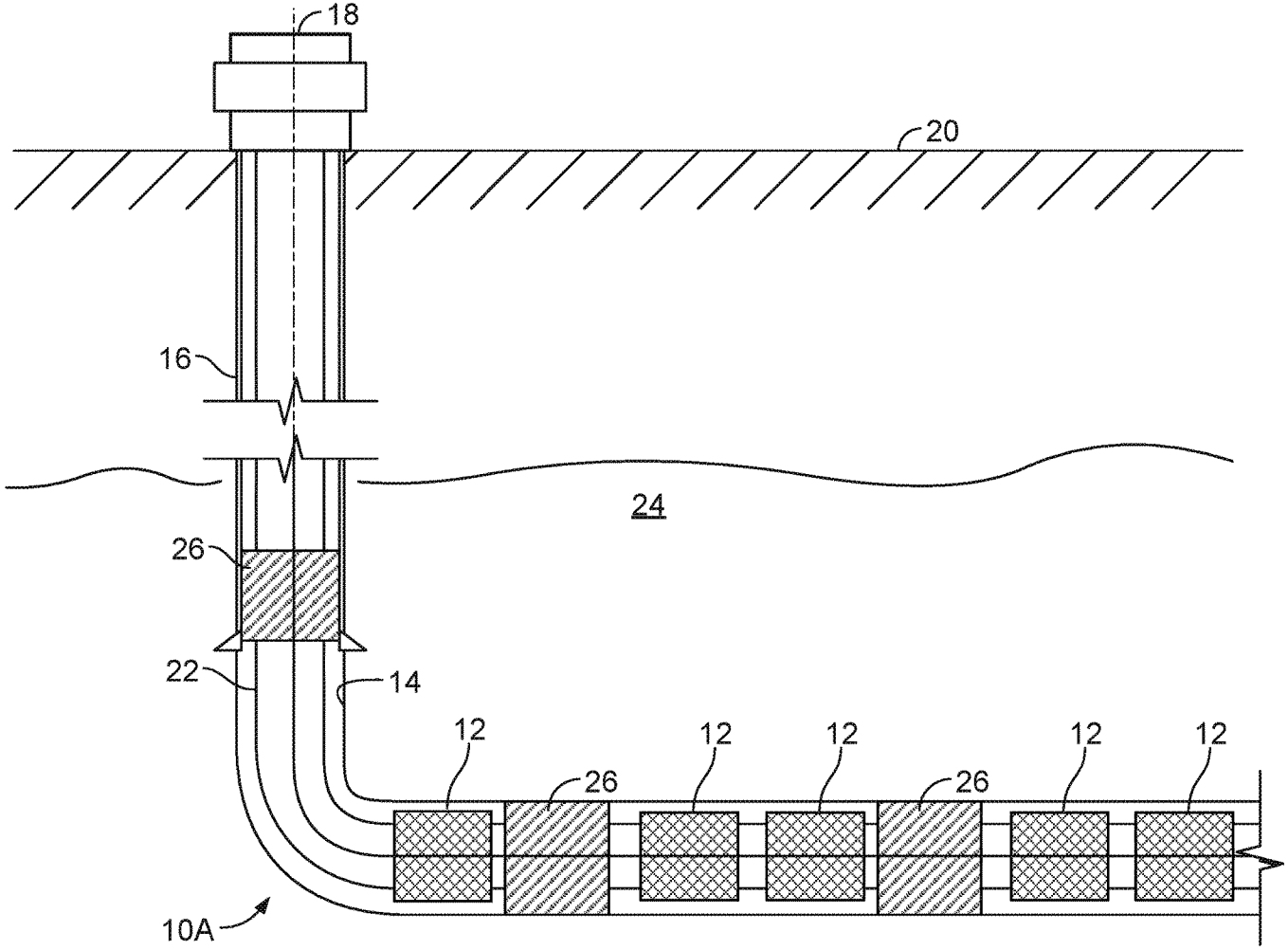
FIG. 1 is a side partial cross-sectional view of an example well system.

FIG. 1 shows an example well system 10 in an open hole completion configuration. The well system 10 is shown as a horizontal well, having a wellbore 14 that deviates to horizontal or substantially horizontal in a subterranean zone of interest 24. A type of production tubing, referred to as casing 16, is cemented in the wellbore 14 and coupled to a wellhead 18 at the surface 20. The casing 16 extends only through the vertical portion of the wellbore 14. The remainder of the wellbore 14 is completed open hole (e.g., without casing). In some alternative implementations, however, one or more casings may be positioned in the wellbore 14 without departing from the scope of this disclosure.

A production tubing string 22 extends from wellhead 18, through the wellbore 14 and into the subterranean zone of interest 24. The production string 22 can take many forms, for example, as a continuous tubing string between the subterranean zone 24 and the wellhead 18, as a length of production liner coupled to the casing 16 at a liner hanger with a tieback liner extending from the liner hanger to the wellhead 18, and/or another configuration. A production packer 26 seals the annulus between the production string 22 and the casing 16. Additional packers 26 can be provided between the screen assemblies 12 to seal the annulus between the wellbore wall and the production string 22. The production string 22 operates in producing fluids (e.g., oil, gas, and/or other fluids) from the subterranean zone 24 to the surface 20.

In certain instances, the production string 22 can also be used in injecting fluids (e.g., acid and/or other fluids) into wellbore 14 and into the subterranean zone 24. The production string 22 includes one or more well screen assemblies 12 (five shown). In some instances, the annulus between the production string 22 and the open hole portion of the wellbore 14 may be packed with gravel and/or sand. The well screen assemblies 12 and gravel/sand packing allow communication of fluids between the subterranean zone 24 and the interior of the production string 22. The gravel/sand packing provides a first stage of filtration against passage of particulate and larger fragments of the formation to the production string 22. The well screen assemblies 12 provide a second stage of filtration, and are configured to filter against passage of particulate of a specified size and larger into the interior center bore production string 22.

One or more of the well screen assemblies 12 is provided with a flow control device that controls flow through the well screen assembly 12, between the bore of the production string 22 and the subterranean zone 24. In some implementations, components of the well screen assembly 12 and the flow control device may reduce, alter, or modify wall shear stress on a tubular member. A flow control device may be positioned in fluid communication with the outlet of the filtration screen to reduce wall shear stress on the tubing or the aperture. In some aspects, the flow control device may be or include a tubular sleeve positioned around the production string 22.

In some aspects, the flow control device may be or include an aperture in the production string 22. The aperture may be shaped or oriented in a direction designed to minimize wall shear stress in the well screen assembly. In some aspects, the flow control device may be or include a flow passage formed in the tubular sleeve. There may be more than one flow passage in the flow control device. In some aspects, the flow passage may be radially offset from one or more apertures in the production string. In some aspects, the flow control device may feature a soft exit to allow the fluid to enter the aperture with minimal turbulence. In other aspects, the flow control device may have a protective lip near the flow restriction. The protective lip may be angled or straight. In other aspects, the flow control device may have a shaped aperture on the base tubing.

Figure 2:
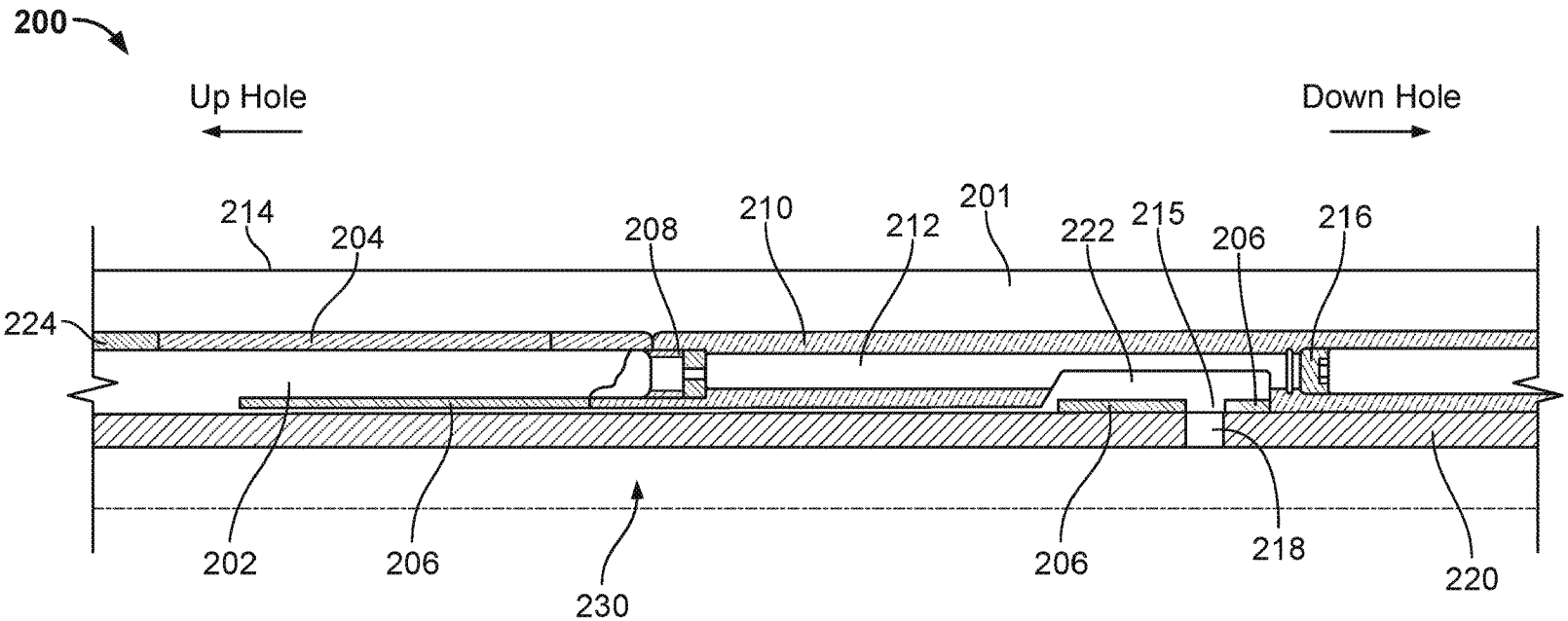
FIG. 2 is a schematic cross-sectional view of a well screen assembly that includes an example implementation of a flow control device.

FIG. 2 shows a schematic cross-sectional view of a well screen assembly 200 that includes an example implementation of a flow control device. Generally, in this implementation of the well screen assembly, the flow control device includes a tubular sleeve wrapped around (e.g., directly radially adjacent) the base tubing. The tubular sleeve serves to reduce wall shear stress by reducing turbulence of the fluid as it moves from the fluid conduit through the aperture into the center bore.

The illustrated implementation of the well screen assembly 200 is shown in a wellbore 214, and an annulus 201 is formed between the wellbore 214 and the well screen assembly 200. The well screen assembly includes a base tubing 220 with a filtration screen assembly 224 positioned circumferentially about the tubing 220. The filtration assembly 224 is sealed (not shown here) at one end to the base tubing 220 and sealed to an outer sleeve 204 of the well screen assembly 200 at its other end. Therefore, flow (e.g., hydrocarbon flow) from a subterranean zone and a center bore 230 of the base tubing 220 (and thus production string) must flow through the filtration assembly 224.

The filter assembly 224 includes a filter that filters against passage of particulate of a specified size or larger in a hydrocarbon fluid flow (e.g., oil, gas, or otherwise). Filter assembly 224 can take a number of different forms and can have one or multiple layers. Some example layers include a preformed woven and/or nonwoven mesh, wire wrapped screen (e.g., a continuous helically wrapped wire), apertured tubing, and/or other types of layers. Filter assembly 224 defines an interior flow passage 212 interior to the filter assembly 224 and/or between the filter assembly 224 and the base tubing 220. The interior flow passage 212 communicates fluid axially along the length of the well screen assembly 200.

The well screen assembly 200 includes an annular housing 210 positioned radially around the tubing 220. The housing 210 further defines the interior flow passage 212 that establishes fluid communication between the internal center bore 230 of the tubing 220, via one or more sidewall aperture 218 in the tubing 220, and the subterranean zone surrounding the well screen assembly 200, via the filtration screen assembly 224. Flow from the axial flow passage is directed into the flow passage 212 via inlet 202.

The well screen assembly 200 includes a flow restriction 208 in the inlet 202 that can produce a specified fixed or variable flow restriction to flow through the flow passage 212. The flow restriction can be a partial restriction or can selectively seal the flow passage 212. The flow restriction 208 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, well screen assembly 200 can be a type of device referred to in the art as an inflow control device (ICD).

In this example implementation of the well screen assembly 200, a flow control device is or includes a tubular sleeve 206 wrapped around (e.g., directly radially adjacent) the base tubing 220. As shown in the example of FIG. 2, the tubular sleeve 206 may have one or more portions, such as a portion wrapped around the base tubing 220 adjacent (e.g., uphole) of the flow restriction 208 and a portion wrapped around the base tubing 220 adjacent the sidewall aperture 218. The tubular sleeve 206 may be composed of a material different than that of the base tubing 220 that resists wall shear better than the base tubing 220. The tubular sleeve 206 may include a hole 215 that establishes fluid communication between the flow passage 212 and the perforation 218. In some implementations, the hole 215 of the tubular sleeve 206 may be radially offset (e.g., 30 degrees or otherwise) from the perforation 218.

In an example operation, a wellbore fluid may be circulated adjacent the well screen assembly 200. For example, a hydrocarbon fluid may flow from a subterranean zone adjacent the well screen assembly 200 through the filtration screen assembly 224. The hydrocarbon flow is filtered by the filtration screen assembly 224 and flows into the inlet 202. The hydrocarbon fluid may flow through the inlet 202 into the flow passage 212 through the nozzle 208. The hydrocarbon flow may then circulate to and through the aperture 215 to enter the hole 218. Upon entering the hole 215, the hydrocarbon fluid may flow into the center bore 230, from where it may be produced to a terranean surface.

As the hydrocarbon fluid flows into the inlet 202 from the filtration screen assembly 224, and into the hole 218 from the flow passage 212, a wall shear stress on the base tubing 220 may be reduced by the presence of the inner sleeve 206. For example, the inner sleeve 206 may help reduce shear stress on the base tubing 220, particularly around the hole 215 in the base tubing 220, simply by covering the base tubing 220 so that the flow does not contact, or has reduced contact with, the base tubing 220. In other implementations, the inner sleeve 206 may be composed of a material that resists wall shear stress better than a material from which the base tubing is made. Such an implementation may be more cost efficient because the harder, and more expensive, material composing the sleeve 206 may account for less material than the material for the base tubing. In another implementation, the hole 215 of the inner sleeve 206 may be radially offset from the perforation 218. This may reduce wall shear stress on the base tubing 220 by, for example, slowing down the fluid flow due to change of direction. In another implementation, the inner sleeve 206 may have more than one hole 215 allowing hydrocarbon fluid to flow into the center bore 230 through the several holes 215.

Figure 3:
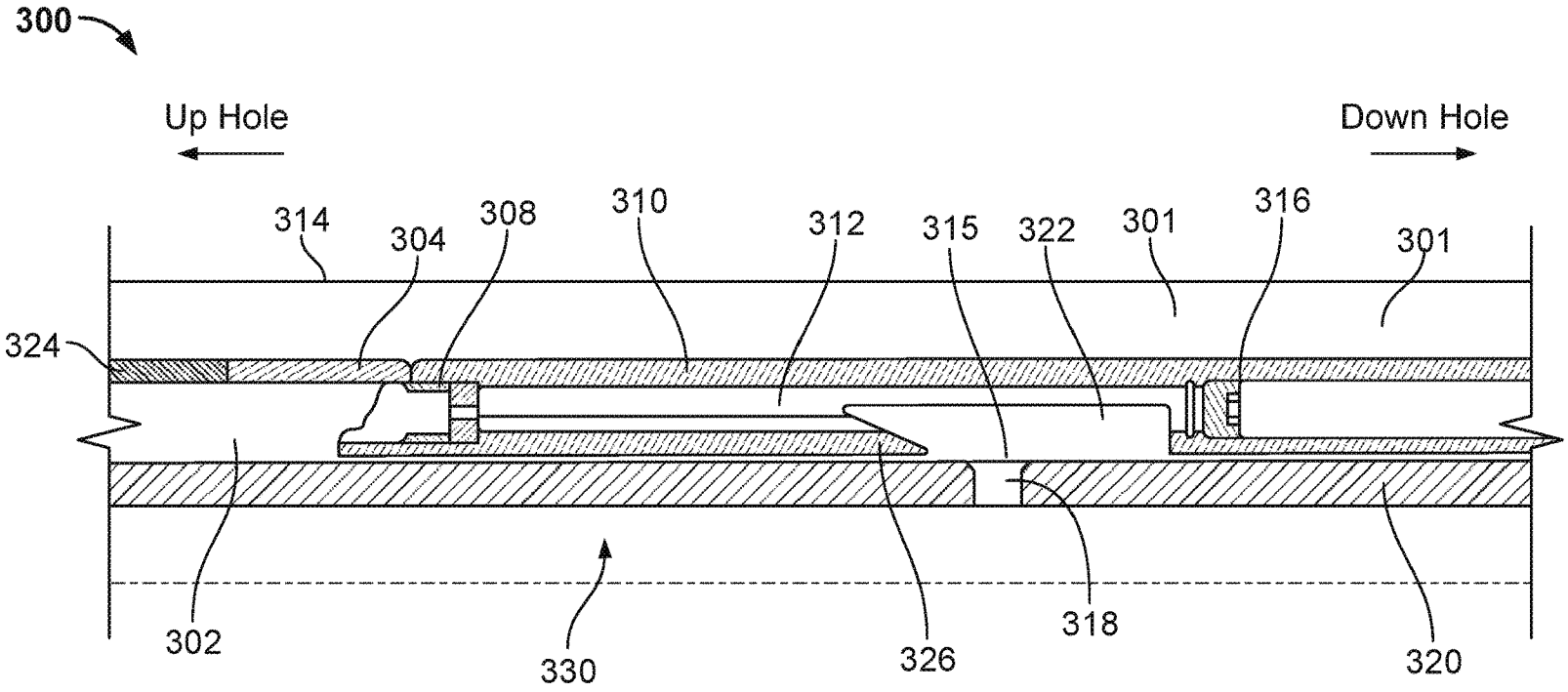
FIG. 3 is a schematic cross-sectional view of a well screen assembly that includes another example implementation of a flow control device.

FIG. 3 shows a schematic cross-sectional view of a well screen assembly 300 that includes another example implementation of a flow control device. Generally, in this implementation of the well screen assembly 300, the flow control device is or includes a soft exit from the inner flow passage through the aperture. The soft exit may serve to reduce wall shear stress by, for example, reducing turbulence of the fluid as it moves from an inner flow chamber through an aperture into a center bore.

The illustrated implementation of the well screen assembly 300 is shown in a wellbore 314, and an annulus 301 is formed between the wellbore 314 and the well screen assembly 300. The well screen assembly includes a base tubing 320 with a filtration screen assembly 324 positioned circumferentially about the tubing 320. The filtration assembly 324 is sealed (not shown here) at one end to the base tubing 320 and sealed to an outer sleeve 304 of the well screen assembly 300 at its other end. Therefore, flow (e.g., hydrocarbon flow) from a subterranean zone and a center bore 330 of the base tubing 320 (and thus production string) must flow through the filtration assembly 324.

The filter assembly 324 includes a filter that filters against passage of particulate of a specified size or larger in a hydrocarbon fluid flow (e.g., oil, gas, or otherwise). Filter assembly 324 can take a number of different forms and can have one or multiple layers. Some example layers include a preformed woven and/or nonwoven mesh, wire wrapped screen (e.g., a continuous helically wrapped wire), apertured tubing, and/or other types of layers. Filter assembly 324 defines an interior flow passage 312 interior to the filter assembly 324 and/or between the filter assembly 324 and the base tubing 320. The interior flow passage 312 communicates fluid axially along the length of the well screen assembly 300.

The well screen assembly 300 includes an annular housing 310 positioned radially around the tubing 320. The housing 310 further defines the interior flow passage 312 that establishes fluid communication between the internal center bore 330 of the tubing 320, via one or more sidewall aperture 318 in the tubing 320, and the subterranean zone surrounding the well screen assembly 300, via the filtration screen assembly 324. Flow from the axial flow passage is directed into the flow passage 312 via inlet 302.

The well screen assembly 300 includes a flow restriction 308 in the inlet 302 that can produce a specified fixed or variable flow restriction to flow through the flow passage 312. The flow restriction can be a partial restriction or can selectively seal the flow passage 312. The flow restriction 308 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, well screen assembly 300 can be a type of device referred to in the art as an inflow control device (ICD).

In this example implementation of the well screen assembly 300, a flow control device is or includes a soft exit 326 from the inner flow passage 312 through the aperture 315. As shown in the example of FIG. 3, the soft exit 326 may be angled such that the fluid entering the aperture 315 experiences reduced turbulence. An angle at which the soft exit 326 enters the aperture 315 may be, for example, 30 degrees with respect to the base tubing 320.

In an example operation, a wellbore fluid may be circulated adjacent the well screen assembly 300. For example, a hydrocarbon fluid may flow from a subterranean zone adjacent the well screen assembly 300 through the filtration screen assembly 324. The hydrocarbon flow is filtered by the filtration screen assembly 324 and flows into the inlet 302. The hydrocarbon fluid may flow through the inlet 302 into the flow passage 312 through the nozzle 308. The hydrocarbon flow may then circulate to and through the aperture 315 to enter the hole 318. Upon entering the hole 318, the hydrocarbon fluid may flow into the center bore 330, from where it may be produced to a terranean surface. As the hydrocarbon fluid flows into the inlet 302 from the filtration screen assembly 324, and into the hole 318 from the flow passage 312, a wall shear stress on the base tubing 320 may be reduced by the soft exit 326. For example, the soft exit 326 may reduce wall shear stress on the base tubing 320, at least in part, by extending to cover a portion of the base tubing 320. The ramped edge of the soft exit 326 may also allow fluid to enter the hole 318 with minimal contact with the base tubing 320.

Figure 4:
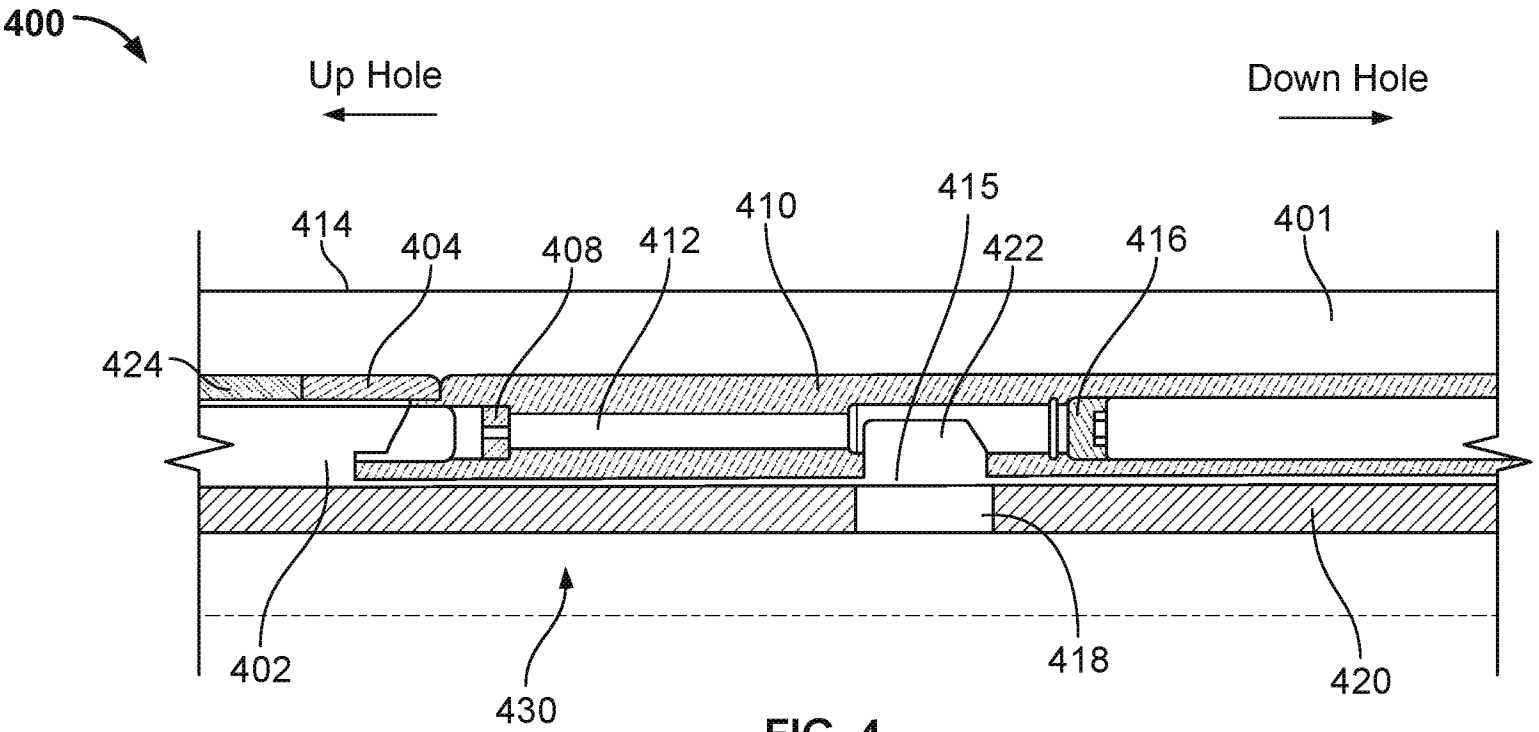
FIG. 4 is a schematic cross-sectional view of a well screen assembly that includes another example implementation of a flow control device.

FIG. 4 shows a schematic cross-sectional view of a well screen assembly 400 that includes another example implementation of a flow control device. Generally, in this implementation of the well screen assembly 400, the flow control device is or includes a larger opening of a fluid chamber to communicate fluid (e.g., a hydrocarbon fluid) to a center bore of a base tubing. The larger opening may serve to reduce wall shear stress on the base tubing by reducing turbulence of the fluid as it moves from the inner flow chamber through an aperture of the base tubing into a center bore.

The illustrated implementation of the well screen assembly 400 is shown in a wellbore 414, and an annulus 401 is formed between the wellbore 414 and the well screen assembly 400. The well screen assembly includes a base tubing 420 with a filtration screen assembly 424 positioned circumferentially about the tubing 420. The filtration assembly 424 is sealed (not shown here) at one end to the base tubing 420 and sealed to an outer sleeve 404 of the well screen assembly 400 at its other end. Therefore, flow (e.g., hydrocarbon flow) from a subterranean zone and a center bore 430 of the base tubing 420 (and thus production string) must flow through the filtration assembly 424.

The filter assembly 424 includes a filter that filters against passage of particulate of a specified size or larger in a hydrocarbon fluid flow (e.g., oil, gas, or otherwise). Filter assembly 424 can take a number of different forms and can have one or multiple layers. Some example layers include a preformed woven and/or nonwoven mesh, wire wrapped screen (e.g., a continuous helically wrapped wire), apertured tubing, and/or other types of layers. Filter assembly 424 defines an interior flow passage 412 interior to the filter assembly 424 and/or between the filter assembly 424 and the base tubing 420. The interior flow passage 412 communicates fluid axially along the length of the well screen assembly 400.

The well screen assembly 400 includes an annular housing 410 positioned radially around the tubing 420. The housing 410 further defines the interior flow passage 412 that establishes fluid communication between the internal center bore 430 of the tubing 420, via one or more sidewall aperture 418 in the tubing 420, and the subterranean zone surrounding the well screen assembly 400, via the filtration screen assembly 424. Flow from the axial flow passage is directed into the flow passage 412 via inlet 402.

The well screen assembly 400 includes a flow restriction 408 in the inlet 402 that can produce a specified fixed or variable flow restriction to flow through the flow passage 412. The flow restriction can be a partial restriction or can selectively seal the flow passage 412. The flow restriction 408 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, well screen assembly 400 can be a type of device referred to in the art as an inflow control device (ICD).

In an example operation, a wellbore fluid may be circulated adjacent the well screen assembly 400. For example, a hydrocarbon fluid may flow from a subterranean zone adjacent the well screen assembly 400 through the filtration screen assembly 424. The hydrocarbon flow is filtered by the filtration screen assembly 324 and flows into the inlet 402. The hydrocarbon fluid may flow through the inlet 402 into the flow passage 412 through the nozzle 408. The hydrocarbon flow may then circulate to and through the aperture 415 to enter the hole 418. Upon entering the hole 418, the hydrocarbon fluid may flow into the center bore 430, from where it may be produced to a terranean surface. As the hydrocarbon fluid flows into the inlet 402 from the filtration screen assembly 424, and into the hole 418 from the flow passage 412, a wall shear stress on the base tubing 420 may be reduced by the larger perforation, or hole, 418. For example, the larger aperture 415 may reduce wall shear stress on the base tubing 420 by reducing the amount of contact between the fluid and the outer radial surface of the base tubing 420. Further, the larger aperture 415 may allow for a reduced velocity of the fluid through the aperture 415 and hole 418 (e.g., based on conservation of mass), which also may reduce or help reduce wall shear.

Figure 5:
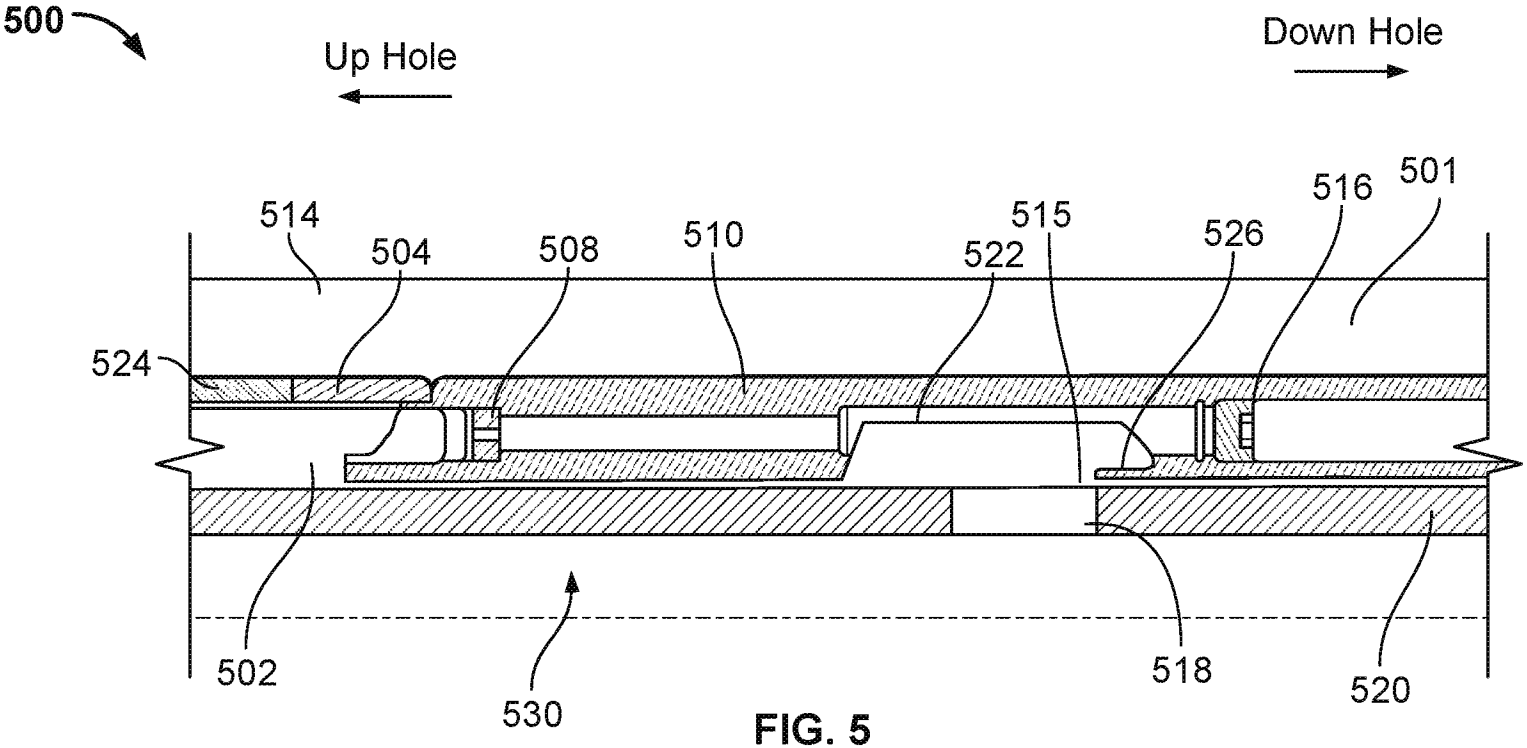
FIG. 5 is a schematic cross-sectional view of a well screen assembly that includes another example implementation of a flow control device.

FIG. 5 shows a schematic cross-sectional view of a well screen assembly 500 that includes another example implementation of a flow control device. Generally, in this implementation of the well screen assembly, the flow control device includes an angled protective lip near the flow restriction that serves to reduce wall shear stress on the base tubing by reducing turbulence of the fluid as it moves from the inner flow chamber through the aperture into the center bore.

The illustrated implementation of the well screen assembly 500 is shown in a wellbore 514, and an annulus 501 is formed between the wellbore 514 and the well screen assembly 500. The well screen assembly includes a base tubing 520 with a filtration screen assembly 524 positioned circumferentially about the tubing 520. The filtration assembly 524 is sealed (not shown here) at one end to the base tubing 520 and sealed to an outer sleeve 504 of the well screen assembly 500 at its other end. Therefore, flow (e.g., hydrocarbon flow) from a subterranean zone and a center bore 530 of the base tubing 520 (and thus production string) must flow through the filtration assembly 524.

The filter assembly 524 includes a filter that filters against passage of particulate of a specified size or larger in a hydrocarbon fluid flow (e.g., oil, gas, or otherwise). Filter assembly 524 can take a number of different forms and can have one or multiple layers. Some example layers include a preformed woven and/or nonwoven mesh, wire wrapped screen (e.g., a continuous helically wrapped wire), apertured tubing, and/or other types of layers. Filter assembly 524 defines an interior flow passage 512 interior to the filter assembly 524 and/or between the filter assembly 524 and the base tubing 520. The interior flow passage 512 communicates fluid axially along the length of the well screen assembly 500.

The well screen assembly 500 includes an annular housing 510 positioned radially around the tubing 520. The housing 510 further defines the interior flow passage 512 that establishes fluid communication between the internal center bore 530 of the tubing 520, via one or more sidewall aperture 518 in the tubing 520, and the subterranean zone surrounding the well screen assembly 500, via the filtration screen assembly 524. Flow from the axial flow passage is directed into the flow passage 512 via inlet 502.

The well screen assembly 500 includes a flow restriction 508 in the inlet 502 that can produce a specified fixed or variable flow restriction to flow through the flow passage 512. The flow restriction can be a partial restriction or can selectively seal the flow passage 512. The flow restriction 508 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, well screen assembly 500 can be a type of device referred to in the art as an inflow control device (ICD).

In an example operation, a wellbore fluid may be circulated adjacent the well screen assembly 500. For example, a hydrocarbon fluid may flow from a subterranean zone adjacent the well screen assembly 500 through the filtration screen assembly 524. The hydrocarbon flow is filtered by the filtration screen assembly 524 and flows into the inlet 502. The hydrocarbon fluid may flow through the inlet 502 into the flow passage 512 through the nozzle 508. The hydrocarbon flow may then circulate to and through the aperture 515 to enter the hole 518. Upon entering the hole 518, the hydrocarbon fluid may flow into the center bore 530, from where it may be produced to a terranean surface. As the hydrocarbon fluid flows into the inlet 502 from the filtration screen assembly 524, and into the hole 518 from the flow passage 512, a wall shear stress on the base tubing 520 may be reduced by the angled protective lip 526. For example, the angled protective lip 26 may reduce wall shear stress on the base tubing 520 by reducing turbulence of the fluid as it moves from the inner flow chamber 512 through the aperture 515 into the center bore 530. In another example, the protective lip 526 is straight rather than angled. The protective lip 526, whether straight or angled, may help to minimize shear stress on the base tubing 520, at least in part, by covering part of the base tubing 520 and limiting the contact between the base pipe 520 and the fluid. In some embodiments, the protective lip 526 may be composed of a material different than that of the base tubing 520 that resists wall shear better than the base tubing 520.

FIG. 6A-6D show schematic cross-sectional views and top views of portions of a base tubing of well screen assemblies that include flow control devices that include a shaped aperture on the base tubing. In some implementations, the shaped apertures (or other wall shear stress reducers) described with respect to FIGS. 6A-6D may be used as or with any one of the apertures 218, 318, 418, 518, or 718 shown in FIGS. 2-5 and 7. Further, in some aspects, a base tubing that includes multiple apertures (e.g., multiple apertures 218, 318, 418, 518, or 718) may include multiple, differently shaped apertures through the base tubing (such as the apertures described in FIGS. 6A-6D). A base tubing that includes multiple apertures (e.g., multiple apertures 218, 318, 418, 518, or 718) may also include multiple similarly-shaped apertures through the base tubing (such as the apertures described in FIGS. 6A-6D).

Figure 6A:
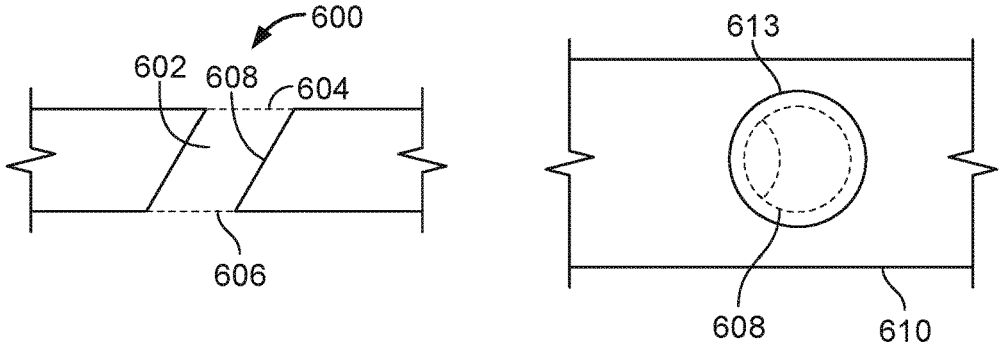
FIG. 6A-6D show schematic cross-sectional views and top views of portions of a base tubing of well screen assemblies that include flow control devices that include a shaped aperture on the base tubing.

For example, FIG. 6A shows a well screen assembly 600 having a circular hole 608 on a base tubing 610. As shown in this figure, the hole 608 is angled through the base tubing 610 with respect to a radial dimension of the base tubing 610 (e.g., radius or diameter). In some implementations, the well screen assembly 600 may also feature an insert 613 (e.g., press fit or threaded) in on the circular hole 608. A threaded insert 613 may be used with other shaped apertures, including but not limited to the other shaped apertures discussed herein. The shape and orientation of the aperture (e.g., straight or angled) may reduce wall shear stress on the base tubing 610 by reducing turbulence of the fluid as it moves from the inner flow chamber through the hole 608 by, for example, reducing the change in direction experienced by the fluid as it flows through the hole 608.

Figure 6B:
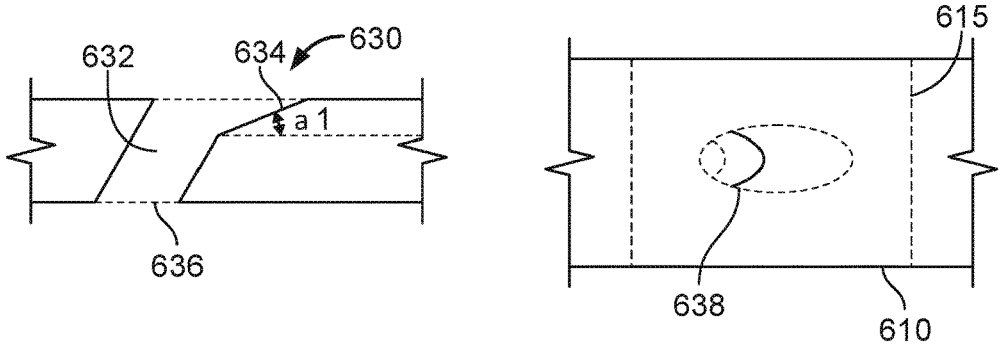

FIG. 6B shows a well screen assembly 630 having an oval hole 638 on a base tubing 610. In some implementations, the well screen assembly 630 may also feature a surface coating 615 applied to base tubing 610. The surface coating 615 may also be used in conjunction with holes of other shapes and sizes. In some implementations, the hole 638 may be angled.

Figure 6C:
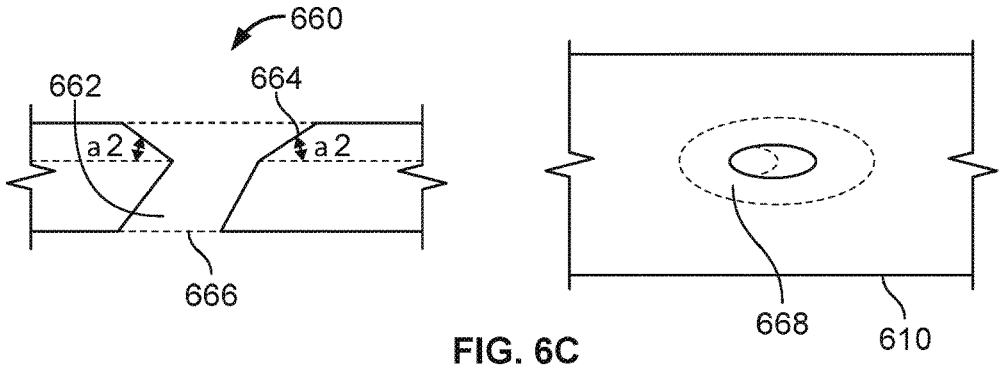

FIG. 6C shows a well screen assembly 660 having an oval hole 668 on a base tubing 610. The opening 664 of the hole 668 inside the well screen assembly 660 may be wider than the exit 666 of the hole 668 into the center bore. In some implementations, the hole 668 may be angled.

Figure 6D:
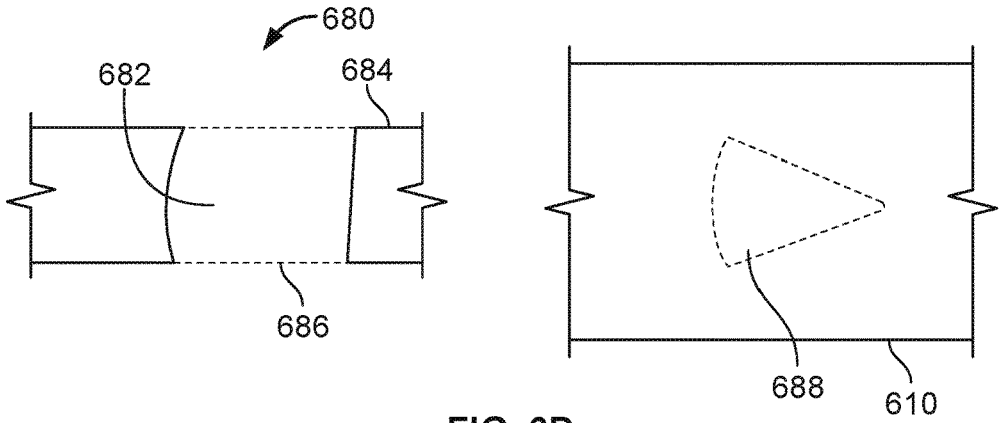

FIG. 6D shows a well screen assembly 680 having a fan-shaped hole 688 on a base tubing 610. In some implementations, the hole 688 may be angled. As with other implementations, the fan-shaped hole 688 may reduce wall shear stress on the base tubing 610 by reducing turbulence of the fluid as it moves from the inner flow chamber through the hole 668. Further, the fan-shaped hole 688 may also provide for better (e.g., more even or consistent) condition of a flow of the hydrocarbon fluid (or other wellbore fluid) through the hole 668. In some aspects, a better flow, such as a flow that is more evenly distributed across a particular area, may provide for one or more of: less turbulence, less or no flow separation, a reduced or eliminated recirculation zone, reduced local flow velocity (e.g., at the hole 668), or flow parallel to the wall surfaces, each of which may reduce wall shear stress.

Figure 7:
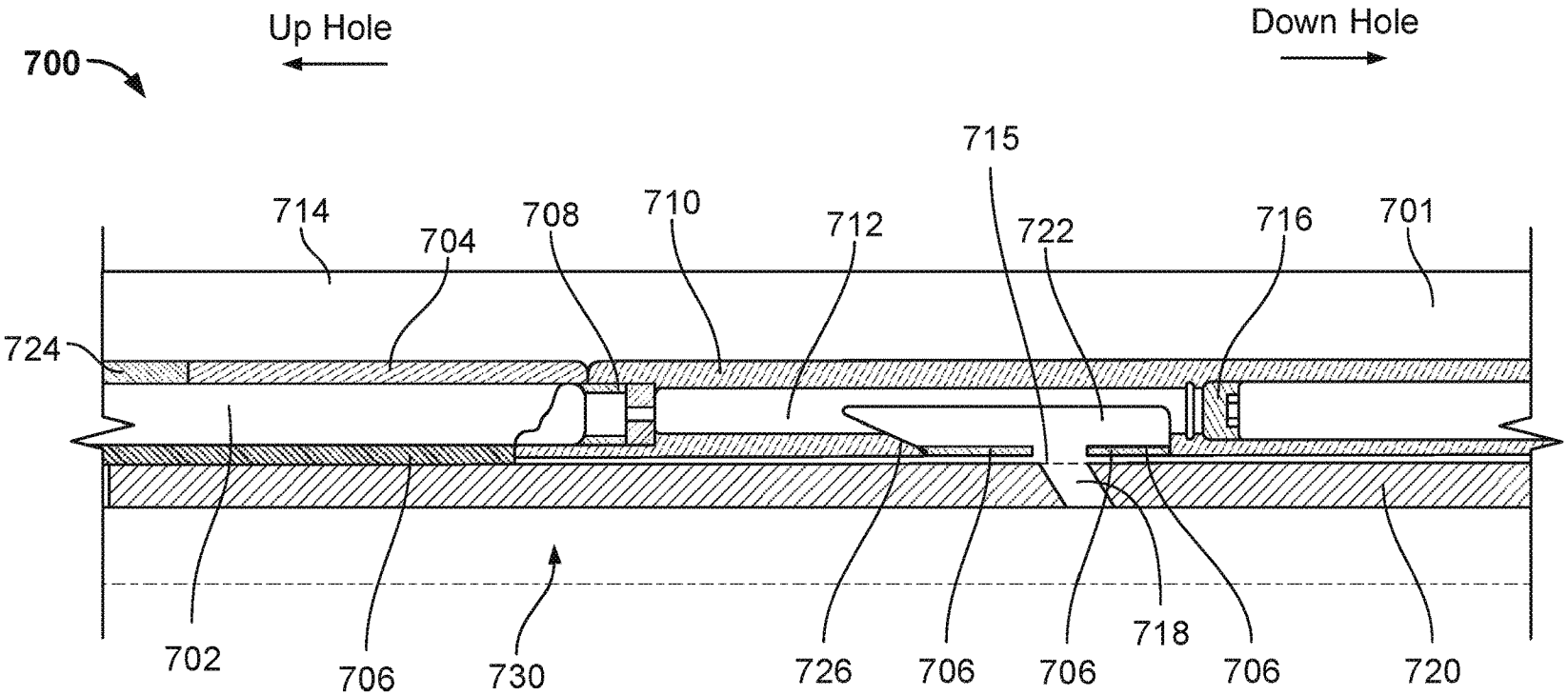
FIG. 7 is a schematic cross-sectional view of a well screen assembly that includes another example implementation of a flow control device.

FIG. 7 shows a schematic cross-sectional view of a well screen assembly 700 that includes another example implementation of a flow control device. Generally, in this implementation of the well screen assembly 700, the flow control device includes a tubular sleeve wrapped around (e.g., directly radially adjacent) the base tubing, a soft exit from the inner flow passage through the aperture, a protective lip near the flow restriction, and an angled hole through the base tubing. These features, in some aspects, serve to reduce wall shear stress of a base tubing of the well screen assembly 700 by, for example, reducing turbulence of the fluid as it moves from the fluid conduit through the aperture into the center bore, reducing contact between a wellbore fluid that causes wall shear stress and the base tubing.

The illustrated implementation of the well screen assembly 700 is shown in a wellbore 714, and an annulus 701 is formed between the wellbore 714 and the well screen assembly 700. The well screen assembly includes a base tubing 720 with a filtration screen assembly 724 positioned circumferentially about the tubing 720. The filtration assembly 724 is sealed (not shown here) at one end to the base tubing 720 and sealed to an outer sleeve 704 of the well screen assembly 700 at its other end. Therefore, flow (e.g., hydrocarbon flow) from a subterranean zone and a center bore 730 of the base tubing 720 (and thus production string) must flow through the filtration assembly 724.

The filter assembly 724 includes a filter that filters against passage of particulate of a specified size or larger in a hydrocarbon fluid flow (e.g., oil, gas, or otherwise). Filter assembly 724 can take a number of different forms and can have one or multiple layers. Some example layers include a preformed woven and/or nonwoven mesh, wire wrapped screen (e.g., a continuous helically wrapped wire), apertured tubing, and/or other types of layers. Filter assembly 724 defines an interior flow passage 712 interior to the filter assembly 724 and/or between the filter assembly 724 and the base tubing 720. The interior flow passage 712 communicates fluid axially along the length of the well screen assembly 700.

The well screen assembly 700 includes an annular housing 710 positioned radially around the tubing 720. The housing 710 further defines the interior flow passage 712 that establishes fluid communication between the internal center bore 730 of the tubing 720, via one or more sidewall aperture 718 in the tubing 720, and the subterranean zone surrounding the well screen assembly 700, via the filtration screen assembly 724. Flow from the axial flow passage is directed into the flow passage 712 via inlet 702.

The well screen assembly 700 includes a flow restriction 708 in the inlet 702 that can produce a specified fixed or variable flow restriction to flow through the flow passage 712. The flow restriction can be a partial restriction or can selectively seal the flow passage 712. The flow restriction 708 can take a number of forms, including fixed or variable orifices, manually operated valves (e.g., operated with a tubing conveyed and/or wire conveyed operating tool downhole or set at the surface by an operator), valves responsive to a surface or downhole signal (e.g., electric, hydraulic, acoustic, optical and/or other signal types), fluid responsive valves (e.g., responsive to fluid pressure, flow rate, viscosity, temperature and/or other fluid characteristics) including fluid diodes, and/or other types of flow restrictions. In certain instances, well screen assembly 700 can be a type of device referred to in the art as an inflow control device (ICD).

In this example implementation of the well screen assembly 700, a flow control device includes a number of components, including, as illustrated, a tubular sleeve 706 wrapped around (e.g., directly radially adjacent) the base tubing 720, a soft exit 726 from the inner flow passage 712 through the aperture 715, and an angled hole 718 through which fluid flows from the flow passage 712 into the center bore 730.

The tubular sleeve 706 may, in some aspects, have one or more portions, such as a portion wrapped around the base tubing 720 adjacent (e.g., uphole) of the flow restriction 708 and a portion wrapped around the base tubing 720 adjacent the sidewall aperture 718. The tubular sleeve 706 may be composed of a material different than that of the base tubing 720 that resists wall shear better than the base tubing 720. The tubular sleeve 706 may include a hole 715 that establishes fluid communication between the flow passage 712 and the perforation 718. In some implementations, the hole 715 of the tubular sleeve 706 may be radially offset (e.g., 30 degrees or otherwise) from the perforation 718. Further, there may be multiple holes 715 in the tubular sleeve 706 to establish fluid communication between the flow passage 712 and the perforation 718.

The soft exit 726, as illustrated, may be angled such that the fluid entering the aperture 715 from the flow passage 712 experiences reduced turbulence. An angle at which the soft exit 726 enters the aperture 715 may be, for example, 30 degrees with respect to the base tubing 720.

The angled hole 718 can be, for example, an angled hole such as the hole 608 shown in FIG. 6A, which is angled through the base tubing 720 with respect to a radial dimension of the base tubing 720 (e.g., radius or diameter). The angled hole 718 can also be an oval hole such as oval hole 638 shown in FIG. 6B. The angled hole 718 can also include a larger inlet than outlet, such as the hole 668 shown in FIG. 6C. Further, the angled hole 718 can also be a fan-shaped hole such as the hole 688 shown in FIG. 6D.

In an example operation, a wellbore fluid may be circulated adjacent the well screen assembly 700. For example, a hydrocarbon fluid may flow from a subterranean zone adjacent the well screen assembly 700 through the filtration screen assembly 724. The hydrocarbon flow is filtered by the filtration screen assembly 724 and flows into the inlet 702. The hydrocarbon fluid may flow through the inlet 702 into the flow passage 712 through the nozzle 708. The hydrocarbon flow may then circulate to and through the aperture 715 to enter the hole 718. Upon entering the hole 718, the hydrocarbon fluid may flow into the center bore 730, from where it may be produced to a terranean surface. As the hydrocarbon fluid flows into the inlet 702 from the filtration screen assembly 724, and into the hole 718 from the flow passage 712, a wall shear stress on the base tubing 720 may be reduced by a tubular sleeve 706 (e.g., by reducing contact between the fluid and the base tubing 720), a soft exit 726 from the inner flow passage through the aperture 718 (e.g., by reducing turbulence of the fluid), and an angled hole 718 through the base tubing 720 (e.g., by reducing turbulence of the fluid). These features may be present in any combination and each contribute to reduce the wall shear stress of the fluid on the base tubing 720 by reducing turbulence of the fluid as it moves from the inner flow chamber 712 through the aperture 715 into the center bore 730, as well as contact between the fluid and the base tubing 720.

Various implementations have been described in the present disclosure. In an example implementation, a well screen assembly includes a tubing including a center bore and at least one aperture through the tubing between an outer radial surface of the tubing and an inner radial surface of the tubing; a filtration screen positioned around the tubing; a housing positioned around the tubing and including a fluid chamber in fluid communication with an outlet of the filtration screen; and a flow control device positioned in fluid communication with the outlet of the filtration screen and the at least one aperture to reduce a wall shear stress on at least one of the tubing or the at least one aperture.

In a first aspect combinable with the example implementation, the flow control device includes a tubular sleeve positioned around the tubing adjacent the at least one aperture.

In a second aspect combinable with any one of the previous aspects, the tubular sleeve includes a perforation therethrough to allow fluid communication from the outlet of the filtration screen, through the tubular sleeve, and to the at least one aperture.

In a third aspect combinable with any one of the previous aspects, the perforation is radially offset from the at least one aperture.

In a fourth aspect combinable with any one of the previous aspects, the tubular sleeve includes a plurality of perforations.

A fifth aspect combinable with any one of the previous aspects further includes a fluid conduit that extends through the housing and is fluidly coupled between the outlet of the filtration screen and the fluid chamber.

In a sixth aspect combinable with any one of the previous aspects, the fluid conduit includes an inlet adjacent the outlet of the filtration screen and an outlet adjacent the fluid chamber, the outlet of the fluid conduit including a slope from the fluid conduit toward the at least one aperture.

In a seventh aspect combinable with any one of the previous aspects, the flow control device includes an outlet of the fluid chamber equal in size to the at least one aperture.

In an eighth aspect combinable with any one of the previous aspects, the outlet of the fluid chamber includes a one inch diameter circular opening.

In a ninth aspect combinable with any one of the previous aspects, the flow control device includes a lip that extends axially from an inner surface of the housing and radially around the tubing adjacent the at least one aperture.

In a tenth aspect combinable with any one of the previous aspects, the lip slopes toward the at least one aperture.

In an eleventh aspect combinable with any one of the previous aspects, the flow control device includes a shape of the at least one aperture.

In a twelfth aspect combinable with any one of the previous aspects, the shape includes a throughbore, from the outer radial surface to the inner radial surface, that is angled relative to the center bore; or a throughbore including an inlet at the outer radial surface and an outlet at the inner radial surface, the inlet larger than the outlet.

In a thirteenth aspect combinable with any one of the previous aspects, the inlet of the throughbore includes a circular inlet or an oval inlet.

In a fourteenth aspect combinable with any one of the previous aspects, the flow control device includes an insertable liner positioned in the at least one aperture.

In another example implementation, a method for reducing a wall shear stress of a well screen assembly includes receiving a flow of a wellbore fluid through a filtration screen positioned around a tubular member, the tubular member including a center bore and at least one aperture through the tubular; directing the wellbore fluid from an outlet of the filtration screen into a fluid chamber of a housing positioned around the tubing; directing the wellbore fluid through the at least one aperture to the center bore of the tubular member; and reducing a wall shear stress on at least one of the tubular member or the at least one aperture from the wellbore fluid directed from the outlet of the filtration screen through the at least one aperture.

In a first aspect combinable with the example implementation, reducing a wall shear stress on at least one of the tubular member or the at least one aperture includes directing the wellbore fluid over a tubular sleeve positioned around the tubular member adjacent the at least one aperture.

A second aspect combinable with any one of the previous aspects further includes directing the wellbore fluid through a perforation in the tubular sleeve and then to the at least one aperture.

In a third aspect combinable with any one of the previous aspects, the perforation is radially offset from the at least one aperture.

A fourth aspect combinable with any one of the previous aspects further includes directing the wellbore fluid through a plurality of perforations in the tubular sleeve and then to the at least one aperture.

A fifth aspect combinable with any one of the previous aspects further includes directing the wellbore fluid from the outlet of the filtration screen, through a fluid conduit that extends through the housing, and into the fluid chamber.

In a sixth aspect combinable with any one of the previous aspects, reducing a wall shear stress on at least one of the tubular member or the at least one aperture includes directing the wellbore fluid through an inlet of the fluid conduit and through an outlet of the fluid conduit that is sloped from the fluid conduit toward the at least one aperture.

In a seventh aspect combinable with any one of the previous aspects, reducing a wall shear stress on at least one of the tubular member or the at least one aperture includes directing the wellbore fluid through an outlet of the fluid chamber to the at least one aperture, the outlet of the fluid chamber equal in size to the at least one aperture.

In an eighth aspect combinable with any one of the previous aspects, reducing a wall shear stress on at least one of the tubular member or the at least one aperture includes covering at least a portion of an outer radial surface of the tubular member with a lip that extends axially from an inner surface of the housing and radially around the outer radial surface of the tubular member adjacent the at least one aperture.

In a ninth aspect combinable with any one of the previous aspects, the lip slopes toward the at least one aperture.

In a tenth aspect combinable with any one of the previous aspects, reducing a wall shear stress on at least one of the tubular member or the at least one aperture includes at least one of directing the wellbore fluid through a throughbore of the at least one aperture that is angled, from an outer radial surface of the tubular member to an inner radial surface of the tubular member, relative to the center bore; or directing the wellbore fluid through a throughbore of the at least one aperture that includes an inlet at the outer radial surface and an outlet at the inner radial surface, the inlet larger than the outlet.

In an eleventh aspect combinable with any one of the previous aspects, the inlet of the throughbore includes a circular inlet or an oval inlet.

In a twelfth aspect combinable with any one of the previous aspects, reducing a wall shear stress on at least one of the tubular member or the at least one aperture includes directing the wellbore fluid through a liner positioned in the at least one aperture.

In another example implementation, an inflow control device (ICD) for a wellbore fluid includes a base pipe that includes a bore and a plurality of perforations; a filter screen wrapped around a portion of the base pipe to fluidly couple the bore with a wellbore annulus; a housing coupled to the filter screen and wrapped around the base pipe, the housing including a flow path that is in fluid communication with the filter screen and the plurality of perforations; and a tubular sleeve that covers a portion of the base pipe to fluidly isolate the portion of the base pipe from the flow path.

In a first aspect combinable with the example implementation, the tubular sleeve includes at least one aperture that fluidly couples the bore with the filter screen through the plurality of perforations.

In a second aspect combinable with any one of the previous aspects, the at least one aperture is radially misaligned with the plurality of perforations.

In a third aspect combinable with any one of the previous aspects, the base pipe includes a first material, and the tubular sleeve includes a second material different than the first material.

In a fourth aspect combinable with any one of the previous aspects, the second material is harder than the first material.

In a fifth aspect combinable with any one of the previous aspects, the second material resists a fluidic shear stress better than the first material.

A sixth aspect combinable with any one of the previous aspects further includes a coating applied to the base pipe between an outer radial surface of the base pipe and the tubular sleeve.

In a seventh aspect combinable with any one of the previous aspects, at least one of the plurality of perforations includes a fluid path that extends between an outer radial surface of the base pipe and an inner radial surface of the base pipe, the fluid path angled relative to the bore.

In an eighth aspect combinable with any one of the previous aspects, at least one of the plurality of perforations includes a fluid path that extends between an outer radial surface of the base pipe and an inner radial surface of the base pipe.

In a ninth aspect combinable with any one of the previous aspects, the fluid path includes a funnel.

A number of implementations have been described. Nevertheless, it will be understood that various modifications may be made. For example, example operations, methods, and/or processes described herein may include more steps or fewer steps than those described. Further, the steps in such example operations, methods, and/or processes may be performed in different successions than that described or illustrated in the figures. Also, although discussed in terms of receiving a hydrocarbon fluid into a well screen assembly, the described flow control devices may also be used to reduce a wall shear stress of a component of a well screen assembly (or other downhole tool) due to, for example, an injected fluid (acid, drilling fluid, fracturing fluid, or other wellbore fluid). As another example, although certain implementations described herein may be applicable to tubular systems (e.g., drillpipe and/or coiled tubing), implementations may also utilize other systems, such as wireline, slickline, e-line, wired drillpipe, wired coiled tubing, and otherwise, as appropriate. Further, although FIGS. 2-5 and 7 are labeled with directions "uphole" and "downhole," these directions may be reversed without affecting the operation of the described well screen assemblies. Accordingly, other implementations are within the scope of the following claims.

What is claimed is:

1. A well screen assembly, comprising:

a tubing comprising a first material and having a center bore and at least one aperture through the tubing between an outer radial surface of the tubing and an inner radial surface of the tubing;

a housing positioned around the tubing defining a fluid chamber;

a fluid restrictor positioned in fluid communication between a wellbore surrounding the tubing and the fluid chamber; and a flow control device configured to reduce a wall shear stress on at least one of the tubing or the at least one aperture, the flow control device comprising a tubular sleeve or coating made of a second different material that resists a fluidic shear stress better than the first material, the flow control device positioned:

in contact with the tubing and surrounding the one or more apertures, the tubular sleeve or coating having one or more perforations there through that at least partially align with the one or more apertures in the tubing; or in contact with and lining the aperture.

2. The well screen assembly of claim 1, wherein the flow control device comprises a tubular sleeve in contact with the tubing and surrounding the aperture and having a single perforation, and further wherein the single perforation allows fluid communication from the wellbore, through the tubular sleeve, and to the center bore of the tubing.

3. The well screen assembly of claim 2, wherein the single perforation is radially offset from the at least one aperture.

4. The well screen assembly of claim 1, wherein the flow control device comprises a tubular sleeve in contact with the tubing and surrounding the aperture and having a plurality of perforations.

5. The well screen assembly of claim 1, wherein the fluid restrictor comprises an inlet adjacent an outlet of a filtration screen and an outlet adjacent the fluid chamber, the outlet of the fluid conduit comprising a slope from the fluid conduit toward the at least one aperture.

6. The well screen assembly of claim 1, wherein an outlet of the fluid chamber is equal in size to the at least one aperture.

7. The well screen assembly of claim 6, wherein the outlet of the fluid chamber comprises a one inch diameter circular opening.

8. The well screen assembly of claim 1, wherein the flow control device further comprises a lip that extends axially from an inner surface of the housing and radially around the tubing adjacent the at least one aperture.

9. The well screen assembly of claim 8, wherein the lip slopes toward the at least one aperture.

10. The well screen assembly of claim 1, a shape of the at least one aperture comprises:

a throughbore, from the outer radial surface to the inner radial surface, that is angled relative to the center bore; or a throughbore comprising an inlet at the outer radial surface and an outlet at the inner radial surface, the inlet larger than the outlet.

11. The well screen assembly of claim 10, wherein the inlet of the throughbore comprises a circular inlet or an oval inlet.

12. A method for reducing a wall shear stress of a well assembly, comprising:

receiving a flow of a wellbore fluid from a wellbore surrounding a tubular member, the tubular member comprising a first material and having a center bore and at least one aperture through the tubular;

directing the wellbore fluid through a fluid restrictor into a fluid chamber defined by a housing positioned around the tubing;

directing the wellbore fluid from the fluid chamber through a flow control device and the at least one aperture to the center bore of the tubular member, the flow control device configured to reduce a wall shear stress on at least one of the tubing or the at least one aperture, the flow control device comprising a tubular sleeve or coating made of a second different material that resists a fluidic shear stress better than the first material, the flow control device positioned:

in contact with the tubing and surrounding the at least one aperture, the tubular sleeve or coating having one or more perforations there through that at least partially align with the at least one aperture in the tubular member; or in contact with and lining the at least one aperture in the tubular member.

13. The method of claim 12, wherein the flow control device comprises a tubular sleeve in contact with the tubing and surrounding the at least one aperture and having a single perforation, and further wherein the single perforation allows fluid communication from the wellbore, through the tubular sleeve, and to the to the center bore of the tubular member.

14. The method of claim 13, wherein the perforation is radially offset from the at least one aperture.

15. The method of claim 12, wherein the flow control device comprises a tubular sleeve in contact with the tubing and surrounding the at least one aperture and having a plurality of perforations.

16. An inflow control device (ICD) for a wellbore fluid, comprising:

a base pipe that comprises a first material and has a bore and a plurality of apertures;

a filter screen wrapped around a portion of the base pipe to fluidly couple the bore with a wellbore annulus;

a housing coupled to the filter screen and wrapped around the base pipe to define a fluid chamber, the housing comprising a flow path that is in fluid communication with the filter screen and the plurality of perforations; and a flow control device configured to reduce a wall shear stress on at least one of the base pipe or the plurality of apertures, the flow control device comprising a tubular sleeve or coating made of a second different material that resists a fluidic shear stress better than the first material positioned in contact with the base pipe and surrounding the one or more apertures, the tubular sleeve or coating having a plurality of perforations there through that at least partially align with the plurality of apertures in the base pipe.

17. The ICD of claim 16, wherein at least one of the plurality of perforations comprises a fluid path that extends between an outer radial surface of the base pipe and an inner radial surface of the base pipe, the fluid path comprising a funnel.

* * * * *